US006287097B1

(12) United States Patent
Takeuchi et al.

(10) Patent No.: US 6,287,097 B1
(45) Date of Patent: Sep. 11, 2001

(54) SCROLL COMPRESSOR HAVING DISCHARGE PORT FORMED ONLY IN END PLATE OF FIXED SCROLL, AND DISCHARGE VALVE ATTACHED TO THE END PLATE

(75) Inventors: Makoto Takeuchi, Nagoya; Tetsuzou Ukai, Nishi-kasugai-gun, both of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,707

(22) Filed: Jun. 7, 2000

(30) Foreign Application Priority Data

Jun. 8, 1999 (JP) ..... 11-161692

(51) Int. Cl.[7] ..... F04C 18/00
(52) U.S. Cl. ..... 418/55.5; 418/57
(58) Field of Search ..... 418/55.5, 57

(56) References Cited

U.S. PATENT DOCUMENTS

| | | | | |
|---|---|---|---|---|
| 4,892,469 | * | 1/1990 | McCullough et al. | 418/55.5 |
| 5,346,376 | | 9/1994 | Bookbinder et al. . | |
| 5,427,510 | * | 6/1995 | Hisanaga et al. | 418/55.5 |
| 5,435,707 | | 7/1995 | Hirano et al. . | |
| 5,447,418 | * | 9/1995 | Takeda et al. | 418/57 |
| 5,494,422 | * | 2/1996 | Ukai et al. | 418/55.2 |
| 5,591,018 | * | 1/1997 | Takeuchi et al. | 418/55.6 |
| 5,674,061 | * | 10/1997 | Motegi et al. | 418/55.1 |
| 5,807,088 | * | 9/1998 | Fukanuma et al. | 418/55.2 |
| 5,951,272 | * | 9/1999 | Fukuhara et al. | 418/55.5 |
| 6,073,454 | * | 6/2000 | Spauschus et al. | 62/114 |

FOREIGN PATENT DOCUMENTS

| | | |
|---|---|---|
| 2 194 291 | 3/1988 | (GB) . |
| 60-23284 | 2/1985 | (JP) . |
| 60-24954 | 7/1985 | (JP) . |

(List continued on next page.)

OTHER PUBLICATIONS

U.S. application No. 09/589,172, filed Jun. 8, 2000, pending, Docket No. 192732US3.
U.S. application No. 09/588,573, filed Jun. 7, 2000, pending, Docket No. 192741US3.
U.S. application No. 09/588,776, filed Jun. 7, 2000, pending, Docket No. 192788US3.
U.S. application No. 09/588,731, filed Jun. 7, 2000, pending, Docket No. 192826US3.

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor comprising a discharge port as small as possible is disclosed, which requires less recompressive force and has improved operational ability. The scroll compressor comprises a casing; a fixed scroll, movable in its axial direction, provided in the housing and comprising an end plate and a spiral protrusion built on one face of the end plate; a revolving scroll provided in the casing and comprising an end plate and a spiral protrusion built on one face of the end plate, wherein the spiral protrusions of each scroll are engaged with each other so as to form a spiral compression chamber; and a back pressure block for supporting the back face of the fixed scroll. In the structure, an introduced working gas is compressed in the compression chamber and then discharged according to the revolving operation of the revolving scroll; a discharge port joining the compression chamber is formed in the end plate of the fixed scroll; the back pressure block has a ring shape, and the inner-peripheral face of the back pressure block and the back face of the fixed scroll form a high-pressure chamber; and a discharge valve for opening and closing the discharge port is attached to the end plate of the fixed scroll and is provided in the high-pressure chamber.

4 Claims, 3 Drawing Sheets

FOREIGN PATENT DOCUMENTS

| | | | | |
|---|---|---|---|---|
| 61-215481 | * | 9/1986 | (JP) | 418/55.5 |
| 04-101001 | * | 4/1992 | (JP) | 418/55.5 |
| 05-149269 | * | 6/1993 | (JP) | 418/55.5 |
| 06-081781 | * | 3/1994 | (JP) | 418/55.5 |
| 06-173864 | * | 6/1994 | (JP) | 418/55.5 |
| 07-012064 | * | 1/1995 | (JP) | 418/55.5 |
| 7-18602 | | 3/1995 | (JP) . | |
| 11-241691 | * | 2/1998 | (JP) | 418/55.5 |
| WO 90/07683 | | 7/1990 | (WO) . | |

* cited by examiner

SCROLL COMPRESSOR HAVING DISCHARGE PORT FORMED ONLY IN END PLATE OF FIXED SCROLL, AND DISCHARGE VALVE ATTACHED TO THE END PLATE

BACKGROUND OF THE INVENTION

1. Field of the Invention

The present invention relates to a scroll compressor, in particular, one suitable for operation in a vapour-compression refrigerating cycle which uses a refrigerant, such as $CO_2$, in a supercritical area thereof.

2. Description of the Related Art

As for the vapour-compression refrigerating cycle, one of the recently proposed measures to avoid the use of Freon (fron, a refrigerant) in order to protect the environment is the use of a refrigerating cycle using $CO_2$ as the working gas (i.e., the refrigerant gas). This cycle is called "$CO_2$ cycle" below. An example thereof is disclosed in Japanese Examined Patent Application, Second Publication, No. Hei 7-18602. The operation of this $CO_2$ cycle is similar to the operation of a conventional vapour-compression refrigerating cycle using Freon. That is, as shown by the cycle A →B→C→D→A in FIG. 3 (which shows a $CO_2$ Mollier chart), $CO_2$ in the gas phase is compressed using a compressor (A→B), and this hot and compressed $CO_2$ in the gas phase is cooled using a gas cooler (B→C). This cooled gas is further decompressed using a decompressor (C→D), and $CO_2$ in the gas-liquid phase is then vaporized (D→A), so that latent heat with respect to the evaporation is taken from an external fluid such as air, thereby cooling the external fluid.

The critical temperature of $CO_2$ is approximately 31° C., that is, lower than that of Freon, the conventional refrigerant. Therefore, when the temperature of the outside air is high in the summer season or the like, the temperature of $CO_2$ at the gas cooler side is higher than the critical temperature of $CO_2$. Therefore, in this case, $CO_2$ is not condensed at the outlet side of the gas cooler (that is, line segment B–C in FIG. 3 does not intersect with the saturated liquid curve SL). In addition, the condition at the outlet side of the gas cooler (corresponding to point C in FIG. 3) depends on the discharge pressure of the compressor and the $CO_2$ temperature at the outlet side of the gas cooler, and this $CO_2$ temperature at the outlet side depends on the discharge ability of the gas cooler and the outside temperature (which cannot be controlled). Therefore, substantially, the $CO_2$ temperature at the outlet side of the gas cooler cannot be controlled. Accordingly, the condition at the outlet side of the gas cooler (i.e., point C) can be controlled by controlling the discharge pressure of the compressor (i.e., the pressure at the outlet side of the gas cooler). That is, in order to keep sufficient cooling ability (i.e., enthalpy difference) when the temperature of the outside air is high in the summer season or the like, higher pressure at the outlet side of the gas cooler is necessary as shown in the cycle E→F→G→H→E in FIG. 3. In order to satisfy this condition, the operating pressure of the compressor must be higher in comparison with the conventional refrigerating cycle using Freon. In an example of an air conditioner used in a vehicle, the operating pressure of the compressor is 3 kg/cm$^2$ in case of using R134 (i.e., conventional Freon), but 40 kg/cm$^2$ in case of $CO_2$. In addition, the operation stopping pressure of the compressor of this example is 15 kg/cm$^2$ in case of using R134, but 100 kg/cm$^2$ in case of $CO_2$.

Here, a general scroll compressor comprises a casing; a fixed scroll and a revolving scroll in the housing, each scroll comprising an end plate and a spiral protrusion built on an inner surface of the end plate, said inner surface facing the other end plate so as to engage the protrusions of each scroll and form a spiral compression chamber. In this structure, the introduced working gas is compressed in the compression chamber and then discharged according to the revolving operation of the revolving scroll. The degradation of the operational ability of such a scroll compressor (using $CO_2$ as the working gas and having high operating pressure) due to the leakage of the working gas may cause a problem. Therefore, in order to prevent such degradation, a floating structure is adopted, in which the fixed scroll can move only in its axial direction, and the back face of this fixed scroll is supported using a back pressure block.

In the above scroll compressor having the floating structure, it is necessary to form a discharge port (called "top clearance") of the compressed gas in the end plate of the fixed scroll and the back pressure block, and to attach a discharge valve at the outside of the back pressure block. Therefore, the clearance volume of the top clearance is large, and thus large recompressive force is necessary, thereby degrading the operational ability of the compressor.

SUMMARY OF THE INVENTION

In consideration of the above circumstances, an objective of the present invention is to provide a scroll compressor comprising a discharge port as small as possible, which requires less recompressive force and has improved operational ability.

Therefore, the present invention provides a scroll compressor comprising:

a casing;

a fixed scroll, movable in its axial direction, provided in the housing and comprising an end plate and a spiral protrusion built on one face of the end plate;

a revolving scroll provided in the casing and comprising an end plate and a spiral protrusion built on one face of the end plate, wherein the spiral protrusions of each scroll are engaged with each other so as to form a spiral compression chamber; and a back pressure block for supporting the back face of the fixed scroll, wherein:

an introduced working gas is compressed in the compression chamber and then discharged according to the revolving operation of the revolving scroll;

a discharge port joining the compression chamber is formed in the end plate of the fixed scroll;

the back pressure block has a ring shape, and the inner-peripheral face of the back pressure block and the back face of the fixed scroll form a high-pressure chamber; and a discharge valve for opening and closing the discharge port is attached to the end plate of the fixed scroll and is provided in the high-pressure chamber.

In this structure, the discharge port is formed only in the end plate of the fixed scroll, and the discharge valve for opening and closing the discharge port is directly attached to the end plate of the fixed scroll. Therefore, it is unnecessary to form a discharge port in the back pressure block and the length and volume of the discharge port can be decreased. As a result, lower recompressive force is necessary, thereby decreasing the necessary energy and improving the operational ability.

Typically, the back pressure block and the fixed scroll have separate bodies, and the scroll compressor has fastening means for detachably attaching the back pressure block to the fixed scroll. Accordingly, the discharge valve can be fastened to the end plate of the fixed scroll before the back pressure block is attached to the fixed scroll. Therefore, the discharge valve can be easily attached and the place of the attachment is less limited.

Preferably, the working gas is carbon dioxide. In this case, the present invention can be effectively applied to a scroll compressor which uses a refrigerating cycle using $CO_2$ as the working gas, and which has a high operating pressure.

DESCRIPTION OF THE PREFERRED EMBODIMENTS

Hereinafter, an embodiment of the scroll compressor according to the present invention will be explained with reference to the drawings.

Figure 2:
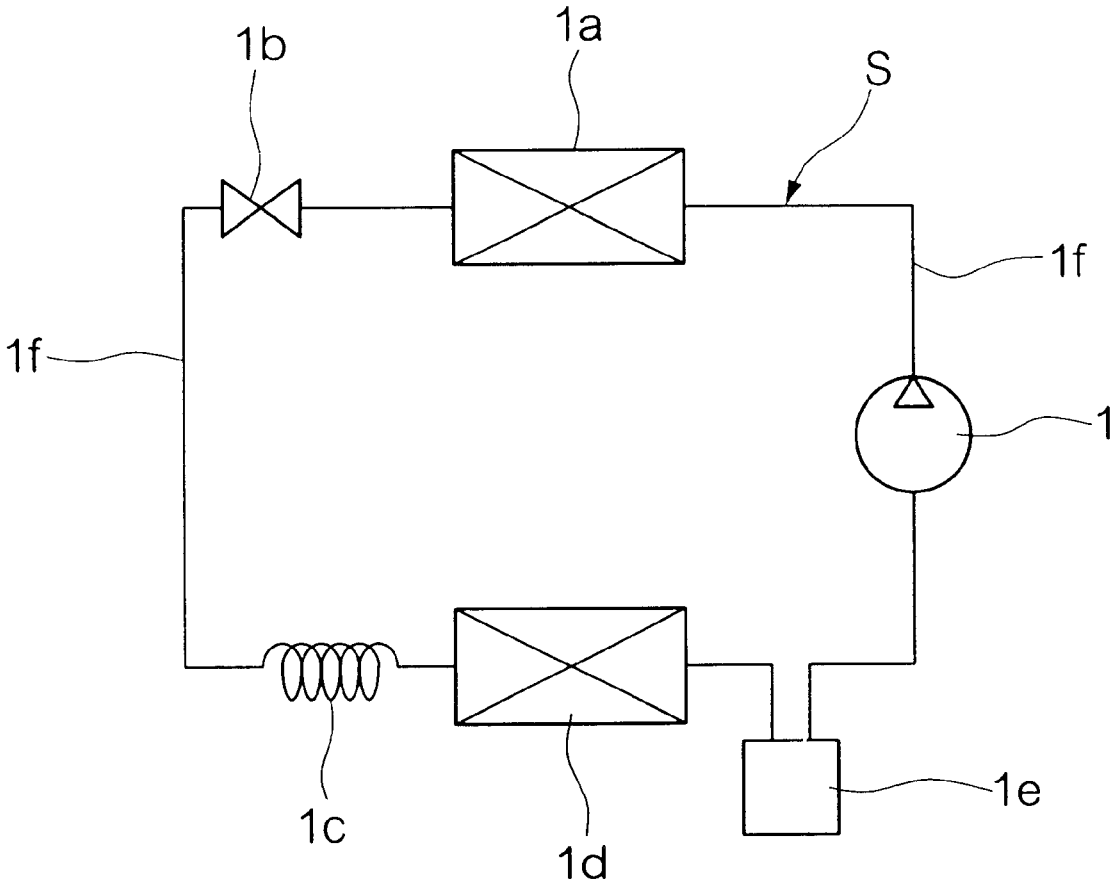
FIG. 2 is a diagram showing a vapour-compression refrigerating cycle.
Figure 3:
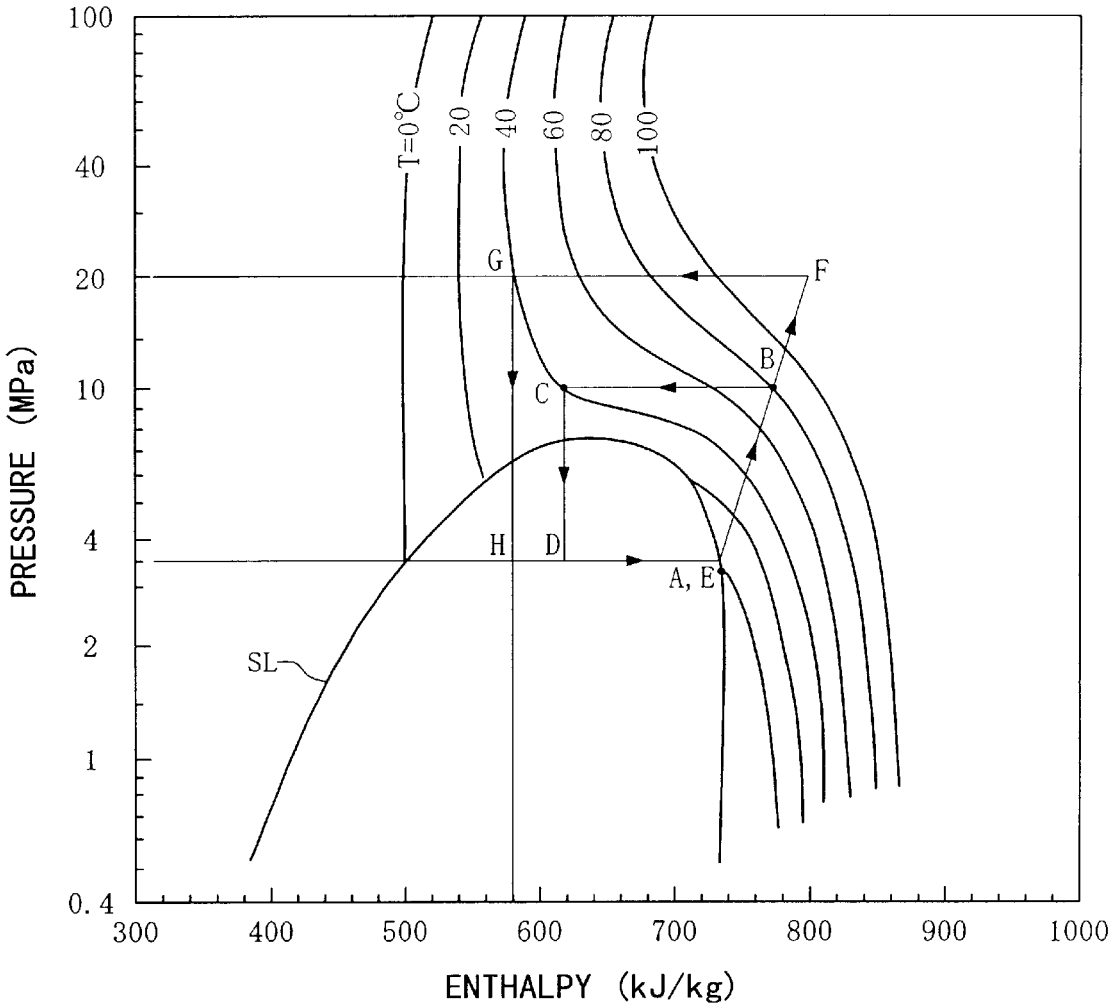
FIG. 3 is a Mollier chart for $CO_2$.

First, the $CO_2$ cycle (structure) including the scroll compressor according to the present invention will be explained with reference to FIG. 2. The $CO_2$ cycle S in FIG. 2 is applied, for example, to the air conditioner of a vehicle. Reference numeral 1 indicates a scroll compressor for compressing $CO_2$ in the gas phase. This scroll compressor 1 receives driving force from a driving power supply (not shown) such as an engine. Reference numeral 1*a* indicates a gas cooler for heat-exchanging $CO_2$ compressed in the scroll compressor 1 and outside air (or the like), so as to cool $CO_2$. Reference numeral 1*b* indicates a pressure control valve for controlling the pressure at the outlet side of the gas cooler 1*a* according to the $CO_2$ temperature at the outlet side of the gas cooler 1*a*. $CO_2$ is decompressed by the pressure control valve 1*b* and restrictor 1*c*, and $CO_2$ enters into the gas-liquid phase (i.e., in the two-phase state). Reference numeral 1*d* indicates an evaporator (i.e., heat absorber) as an air cooling means in the cabin of the vehicle. When $CO_2$ in the gas-liquid two-phase state is vaporized (or evaporated) in the evaporator 1*d*, $CO_2$ takes heat (corresponding to the latent heat of $CO_2$) from the air in the cabin so that the air in the cabin is cooled. Reference numeral 1*e* indicates an accumulator for temporarily storing $CO_2$ in the gas phase. The scroll compressor 1, gas cooler 1*a*, pressure control valve 1*b*, restrictor 1*c*, evaporator 1*d*, and accumulator 1*e* are connected via piping 1*f* so as to form a closed circuit.

Figure 1:
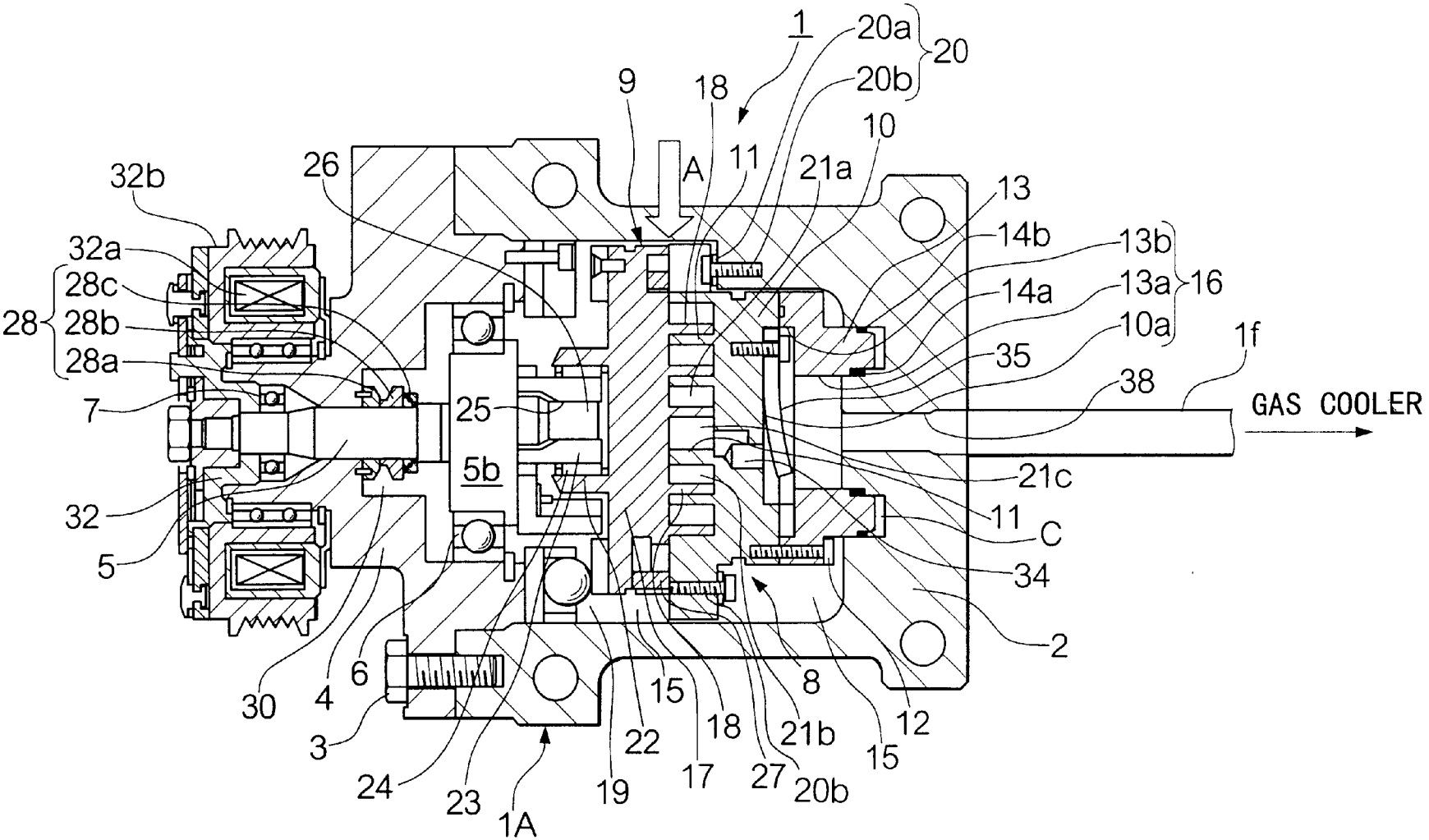
FIG. 1 is a cross-sectional view in the longitudinal direction of an embodiment of the scroll compressor according to the present invention.

An embodiment of the scroll compressor 1 will be explained with reference to FIG. 1.

Housing (or casing) 1A of scroll compressor 1 includes cup-like main body 2, and front case (i.e., crank case) 4 fastened to the main body 2 via bolt 3. Reference numeral 5 indicates a crank shaft which pierces the front case 4 and is supported via main bearing 6 and sub bearing 7 by the front case 4 in a freely-rotatable form. The rotation of the engine (not shown) of the vehicle is transmitted via a known electromagnetic clutch 32 to the crank shaft 5. Reference numerals 32*a* and 32*b* respectively indicate the coil and pulley of the electromagnetic clutch 32.

In the housing 1A, fixed scroll 8 and revolving scroll 9 are provided.

The fixed scroll 8 comprises end plate 10 and spiral protrusion (i.e., lap) 11 disposed on a surface of the plate 10, and the surface facing end plate 17 explained later. A ring-shaped back pressure block 13 is detachably attached to the back face of end plate 10 by using a plurality of bolts 12 as fastening means. O rings 14*a* and 14*b* are provided (or embedded) in the inner-peripheral and outer-peripheral faces of the back pressure block 13. These O rings 14*a* and 14*b* closely contact the inner-peripheral face of main body 2 of the casing, and high-pressure chamber (discharge chamber, explained later) 16 is separated from low-pressure chamber (suction chamber) in the main body 2 of the casing. The high-pressure chamber 16 consists of a space surrounded by smaller-diameter face 13*a* of the back pressure block 13, a space surrounded by larger-diameter face 13*b* of the back pressure block 13, this space being formed continuously with the above space surrounded by face 13*a*, and a space surrounded by concave portion 10*a* formed in the back face of the end plate 10 of fixed scroll 8, this space being formed continuously with the above space surrounded by face 13*b*. In the end plate 10 of fixed scroll 8, discharge port 34 (i.e., top clearance) is opended, and discharge valve 35 for opening/closing this discharge port 34 is provided in the concave portion 10*a*.

The revolving scroll 9 comprises end plate 17 and spiral protrusion (i.e., lap) 18 which is disposed on a surface of the plate 17, the surface facing the end plate 10. The shape of the spiral protrusion 18 is substantially the same as that of the spiral protrusion 11 of the fixed scroll 8.

A ring-shaped plate spring 20*a* is provided between the fixed scroll 8 and the main body 2 of the casing. A plurality of predetermined positions of the plate spring 20*a* are alternately fastened to the fixed scroll 8 and to the main body 2 via bolts 20*b*. According to this structure, the fixed scroll 8 can move only in its axial direction by the (amount of) maximum flexure of plate spring 20*a* in the axial direction (i.e., a floating structure). The above ring-shaped plate springs 20*a* and bolts 20*b* form fixed scroll supporting axis (or axial-direction compliance supporting apparatus) 20. Between the portion protruding from the back face of the back pressure block 13 and housing 1A, gap C is provided, so that the back pressure block 13 can move in the axial direction described above. The fixed scroll 8 and the revolving scroll 9 are engaged in a manner such that the axes of these scrolls are eccentrically separated from each other by the radius of revolution (that is, in an eccentric form), and the phases of these scrolls differ from each other by 180° (refer to FIG. 1). In addition, tip seals (not shown), provided and buried at the head surface of spiral protrusion 11, are in close contact with the inner surface (facing the end plate 10) of end plate 17, while tip seals (not shown), provided and buried at the head surface of spiral protrusions 18, are in close contact with the inner surface (facing the end plate 17) of end plate 10. Furthermore, the side faces of the spiral protrusions 11 and 18 contact each other at some positions so that enclosed spaces 21*a* and 21*b* are formed essentially at positions of point symmetry with respect to the center of the spiral. In addition, rotation-preventing ring (i.e., Oldham coupling) 27 for permitting the revolving scroll 9 to revolve, but prohibiting the rotation of the scroll 9 is provided between the fixed scroll 8 and revolving scroll 9.

A boss 22 is provided on (or projects from) a central area of the outer surface of the end plate 17. A freely-rotatable drive bush 23 is inserted in the boss 22 via revolving bearing (or drive bearing) 24 which also functions as a radial bearing. In addition, a freely-rotatable eccentric shaft 26, projecting from the inner-side end of the crank shaft 5, is inserted in through hole 25 provided in the drive bush 23. Furthermore, thrust ball bearing 19 for supporting the revolving scroll 9 is provided between the outer-circumferential edge of the outer surface of end plate 17 and the front case 4.

A known mechanical seal (i.e., shaft seal) 28 used for sealing a shaft is provided around the crank shaft 5, and this mechanical seal 28 comprises seat ring 28*a* fixed to the front case 4, and slave ring 28*b* which rotates together with crank shaft 5. This slave ring 28*b* is forced by forcing member 28*c* towards seat ring 28*a* and closely contacts the seat ring 28*a*, so that the slave ring 28*b* rotationally slides on the seat ring 28*a* in accordance with the rotation of the crank shaft 5.

The operation of the scroll compressor 1 will be explained below.

When the rotation of the vehicle engine is transmitted to the crank shaft 5 by energizing the coil 32*a* of the electromagnetic clutch 32, the revolving scroll 9 is driven by the rotation of the crank shaft 5, transmitted via the revolution driving mechanism consisting of eccentric shaft 26, through hole 25, drive bush 23, revolving bearing 24, and boss 22. The revolving scroll 9 revolves along a circular orbit having a radius of revolution, while rotation of the scroll 9 is prohibited by the rotation-preventing ring 27.

In this way, line-contact portions in the side faces of spiral protrusions 11 and 18 gradually move toward the center of the "swirl", and thereby enclosed spaces (i.e., compression chambers) 21*a* and 21*b* also move toward the center of the swirl while the volume of each chamber is gradually reduced.

Accordingly, the working gas (refer to arrow A), which has flowed into suction chamber 15 through a suction inlet (not shown), enters enclosed space 21*a* from an opening at the ends of the spiral protrusions 11 and 18 and reaches center space 21*c* while the gas is compressed. The compressed gas then passes through discharge port 34 provided in the end plate 10 of the fixed scroll 8, and opens discharge valve 35, so that the gas is discharged into high-pressure chamber 16. The gas is further discharged outside via discharge outlet 38. In this way, according to the revolution of the revolving scroll 9, the fluid introduced from the suction chamber 15 is compressed in the enclosed spaces 21*a* and 21*b*, and this compressed gas is discharged.

When the energizing process for coil 32*a* of electromagnetic clutch 32 is released so as to stop transmission of the rotating force to crank shaft 5, the operation of the scroll compressor 1 is stopped. When the coil 32*a* of electromagnetic clutch 32 is energized again, the scroll compressor 1 is activated again.

In the above-explained structure of the scroll compressor 1, discharge port (i.e., top clearance) 34 is formed only in the end plate 10 of fixed scroll 8, and discharge valve 35 for opening/closing the discharge port 34 is directly attached to the end plate 10 of fixed scroll 8. Therefore, it is unnecessary to form discharge port 34 in the back pressure block 13, thereby decreasing the length and volume of the discharge port 34. Accordingly, lower recompressive force of the compressor is necessary, thereby improving the operational ability.

In addition, back pressure block 13 and fixed scroll 8 have separate bodies, and the back pressure block 13 is detachably attached to the fixed scroll 8 using bolts 12 (i.e., fastening means). In this structure, it is possible to easily attach discharge valve 35 to the end plate 10 of fixed scroll 8 before the back pressure block 13 is attached to the fixed scroll 8, and the place of attachment is less limited.

In the above explained embodiment, the open-type compressor is applied to the $CO_2$ cycle using $CO_2$ as the working gas; however, the application is not limited to this type, and the compressor according to the present invention can be applied to the vapour-compression refrigerating cycle using a conventional working gas such as freon.

What is claimed is:

1. A scroll compressor comprising:

a casing;

a fixed scroll provided in said casing and including a fixed scroll end plate and a fixed scroll spiral protrusion built on a first face of said fixed scroll end plate, wherein said fixed scroll is supported in a manner such that said fixed scroll is movable in an axial direction of said casing;

a revolving scroll provided in said casing and including a revolving scroll end plate and a revolving scroll spiral protrusion built on a first face of said revolving scroll end plate, wherein said fixed scroll spiral protrusion and said revolving scroll spiral protrusion are engaged with each other so as to form a spiral compression chamber; and a back pressure block fixed on a back face of said fixed scroll end plate and fit to an inner-peripheral face of said casing via a sealing device so that said back pressure block is also movable in said axial direction of said casing, wherein:

an introduced working gas is compressed in said spiral compression chamber and then discharged according to a revolving operation of said revolving scroll;

a discharge port joining said spiral compression chamber is formed in said fixed scroll end plate;

said back pressure block has a ring shape, and all of said inner-peripheral face of said back pressure block, said inner-peripheral face of said casing, and said back face of said fixed scroll form a high-pressure chamber having a suitable volume; and a discharge valve for opening and closing said discharge port is attached to said back face of said fixed scroll end plate and is provided in said high-pressure chamber.

2. The scroll compressor as claimed in claim 1, wherein said back pressure block and said fixed scroll have separate bodies, and said scroll compressor has fastening means for detachably attaching said back pressure block to said fixed scroll.

3. The scroll compressor as claimed in claim 1, wherein the introduced working gas compressed in said spiral compression chamber is carbon dioxide.

4. The scroll compressor as claimed in claim 2, wherein the introduced working gas compressed in said spiral compression chamber is carbon dioxide.

* * * * *